US011109665B1

(12) United States Patent
Rutherford

(10) Patent No.: US 11,109,665 B1
(45) Date of Patent: Sep. 7, 2021

(54) POINT OF APPLIED FORCE LIFT STRUCTURE

(71) Applicant: Sean Edward Rutherford, Birmingham, MO (US)

(72) Inventor: Sean Edward Rutherford, Birmingham, MO (US)

( * ) Notice: Subject to any disclaimer, the term of this patent is extended or adjusted under 35 U.S.C. 154(b) by 0 days.

(21) Appl. No.: 15/001,171

(22) Filed: Jan. 19, 2016

(51) Int. Cl.
*A45F 5/10* (2006.01)

(52) U.S. Cl.
CPC ..... *A45F 5/10* (2013.01)

(58) Field of Classification Search
CPC .. A61F 13/105; A45F 2005/1073; A45F 5/00; A45F 5/02; A45F 5/10; B65D 23/12; B65D 23/14; B65D 5/4208
USPC ..... 294/25, 137; 224/218, 930
See application file for complete search history.

(56) References Cited

U.S. PATENT DOCUMENTS 1,324,354 A * 12/1919 Kaiser ..... B65D 45/24 215/293
1,350,167 A * 8/1920 Mosley ..... B65D 45/18 215/296
3,342,443 A * 9/1967 Bennyhoff ..... A61J 9/06 248/104
3,773,287 A * 11/1973 Hechinger ..... A61J 9/0623 19/159 A
4,881,668 A * 11/1989 Kitterman ..... B65D 47/0876 222/482
5,480,043 A * 1/1996 Wingo ..... A61J 11/04 215/11.1
D412,663 S * 8/1999 Erickson ..... D9/752
6,959,827 B2 * 11/2005 Morano ..... A47G 19/2272 215/11.1
7,216,837 B2 * 5/2007 Pineda ..... A47G 7/025 248/104
7,484,652 B2 * 2/2009 Kalberer ..... B65D 25/2876 229/117.23
7,686,269 B1 * 3/2010 Beal ..... A61J 1/16 248/104
7,946,250 B2 * 5/2011 Holms ..... A01K 63/006 119/245
8,047,387 B2 * 11/2011 Chalekian ..... B65D 51/242 215/305
8,313,132 B2 * 11/2012 Kuzma ..... B65D 23/104 206/151
8,419,092 B2 * 4/2013 Zimmermann ..... A47G 21/001 2/16
8,544,915 B1 * 10/2013 Winkler ..... A45F 5/10 294/160

(Continued)

*Primary Examiner* — Stephen A Vu
(74) *Attorney, Agent, or Firm* — Chernoff, Vilhauer, McClung & Stenzel, LLP

(57) ABSTRACT

A structure which is designed such that its shape provides a surface where force may be applied to as little as a single point or surface of contact to establish control of the Point Of Applied Force Lift Structure (POAFLS) movement. This force combined with the gravity on and/or the inertia of the POAFLS provide comfortable control in 3 dimensions. The POAFLS primary use is achieved through its attachment to a secondary object. Through this, force applied to the POAFLS is translated through the POAFLS to the object to which the POAFLS is attached. Both the POAFLS and the secondary object have their movements controlled when the POAFLS is lifted, moved, or carried.

13 Claims, 9 Drawing Sheets

(56) References Cited

U.S. PATENT DOCUMENTS

| | | | | |
|---|---|---|---|---|
| 8,672,374 | B1 * | 3/2014 | Webber | F16M 11/041 224/217 |
| 8,740,271 | B1 * | 6/2014 | Preston | A47J 45/00 294/25 |
| 8,864,199 | B2 * | 10/2014 | Cook | A47G 29/126 294/25 |
| 9,107,489 | B1 * | 8/2015 | Wisniewski | A45F 5/10 |
| 2002/0084241 | A1 * | 7/2002 | Yu-Hsien | B65D 51/242 215/305 |
| 2002/0148868 | A1 * | 10/2002 | Dion-Bildstein | B60N 3/103 224/401 |
| 2003/0230906 | A1 * | 12/2003 | Bennett | B25B 9/02 294/99.2 |
| 2008/0034791 | A1 * | 2/2008 | Arcadi | A44C 9/0061 63/15 |
| 2011/0298229 | A1 * | 12/2011 | Hager | A47J 45/10 294/31.1 |
| 2016/0120707 | A1 * | 5/2016 | Ramirez | A41D 13/087 2/21 |

* cited by examiner

POINT OF APPLIED FORCE LIFT STRUCTURE

BRIEF SUMMARY OF THE INVENTION

In one embodiment of the present invention, a Point Of Applied Force Lift Structure (POAFLS), or "lift structure", which is designed so that its shape provides a surface where force may be applied to as little as a single point or surface of contact to establish control of the POAFLS movement. When attached to a secondary object this attachment translates the force applied to the POAFLS to the object to which the POAFLS is attached. Both the POAFLS and the secondary object are then controlled when the POAFLS is lifted, moved, or carried. The attachment of the POAFLS to the supported object may be accomplished through primary, secondary, or tertiary means.

In another embodiment of the present invention, two POAFLS may be situated on the neck of a bottle/container, such that one is on each side of the neck of the bottle/container.

In another embodiment of the present invention, a POAFLS may be mounted on a container using a hinged attachment allowing the POAFLS to maintain an attitude or position different from that of the container to which it is attached.

In yet another embodiment of the present invention, a POAFLS having a larger area may be attached to a container at an angle. Such a POAFLS provides space for a plurality of means, such as two fingertips, to facilitate the handling of heavier objects. The angle of attachment of a POAFLS to the container allows the POAFLS to be approximately level while the object to which it is attached hangs at an angle such that the center of gravity of the object is almost directly beneath the position of the POAFLS attached at the object's side.

In another embodiment of the present invention, a POAFLS may have a curved surface. This would allow the contact load to be more evenly distributed across a means applying force to the POAFLS improving comfort of use.

In another embodiment of the present invention, a circular POAFLS may be attached over a depression located in a cap. This would allow for a container with a wider mouth to still have a POAFLS easily accessible. This also removes the necessity of modifying a container that currently does not have a POAFLS. This allows for fewer changes in an assembly line.

In another embodiment of the present invention, a POAFLS may be attached to a cap by means of legs that slide into place from the side of the POAFLS as the POAFLS is raised from the cap In another embodiment of the present invention, a POAFLS may be attached to a cap by an anchor sliding up and retained in a well in the cap.

In another embodiment of the present invention, two POAFLS may be attached to a ring. The ring is attached to a container. This allows the POAFLS to easily be constructed of different material from the container. This secondary attachment also allows the attachment to be made at the end of the production line reducing the number of changes required in the production line.

DETAILED DESCRIPTION OF THE INVENTION

A POAFLS or lift structure comprises a structure designed such that its shape provides a surface, which supports the application of a force against that surface to produce a clean controlled movement of the POAFLS. The contact surface will often be smooth and flat, though other shapes, textures and variations of the surface are envisioned providing extended function of the contact surface. POAFLS are designed to require no more than the force applied to the POAFLS coupled with the force of gravity on and/or the inertia of the POAFLS and any object to which said POAFLS is attached to control its movement. The force applied against the contact surface of a POAFLS is envisioned to be commonly provided by the end segment or tip of a finger, though other sources are envisioned as well. This allows movement to be controlled by a touch and not require a grasp or any of the other current standard methods of controlling the movements of objects. This is a single point of contact method.

Figure 1:
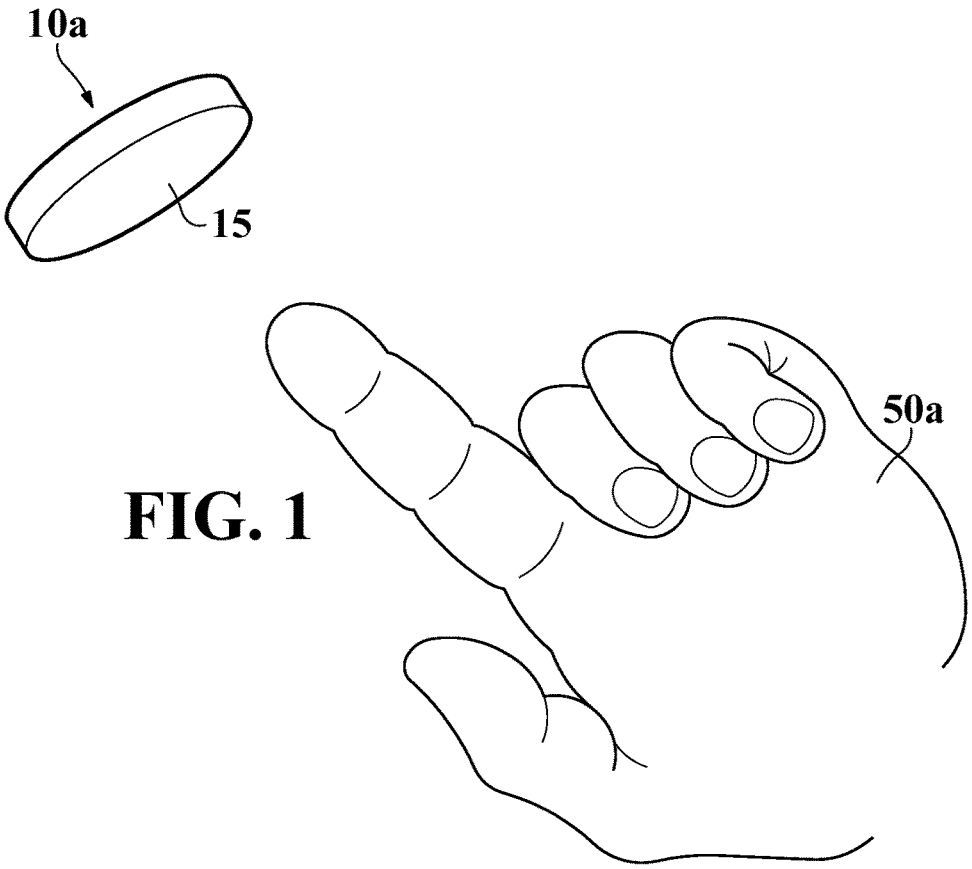
FIG. 1 is a perspective view of a POAFLS.
Figure 1A:
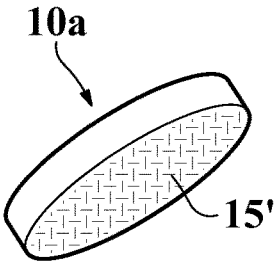
FIG. 1A is a perspective view of a POAFLS similar to that shown in FIG. 1, but having a textured contact surface

FIG. 1 is a perspective view of POAFLS 10*a*. The contact surface 15 of POAFLS 10*a* has a smooth finish and is designed to be lifted, carried, or transported comfortably, as will be described in more detail. Additionally while the contact surface 15 pictured is smooth, other contact surfaces may be provided with a wide variety of textures and finishes to improve usability based on the task to which a POAFLS is applied. When a force is applied to contact surface 15 of POAFLS 10*a*, using the surface of the end segment of the index finger of hand 50*a* for illustration purposes, an acceleration in a single direction is produced. This combined with the inertia of POAFLS 10*a* and the force of gravity on 10*a* will produce a controlled movement.

Figure 2:
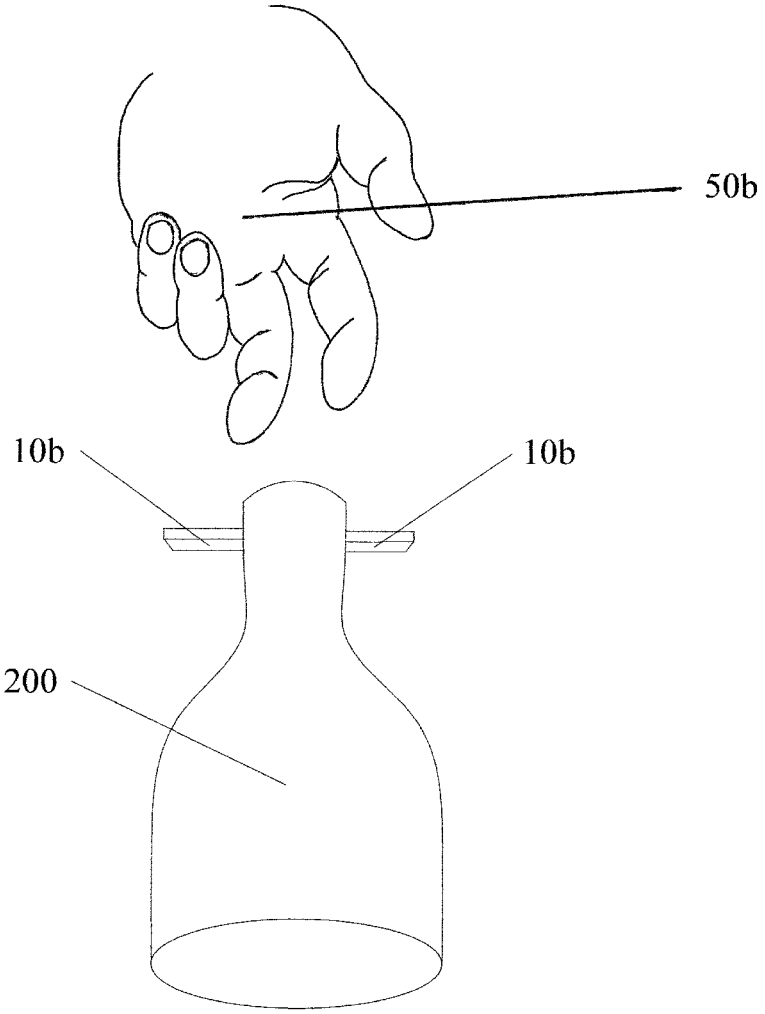
FIG. 2 is a perspective view of two POAFLS attached to the neck of a bottle/container.
Figure 3:
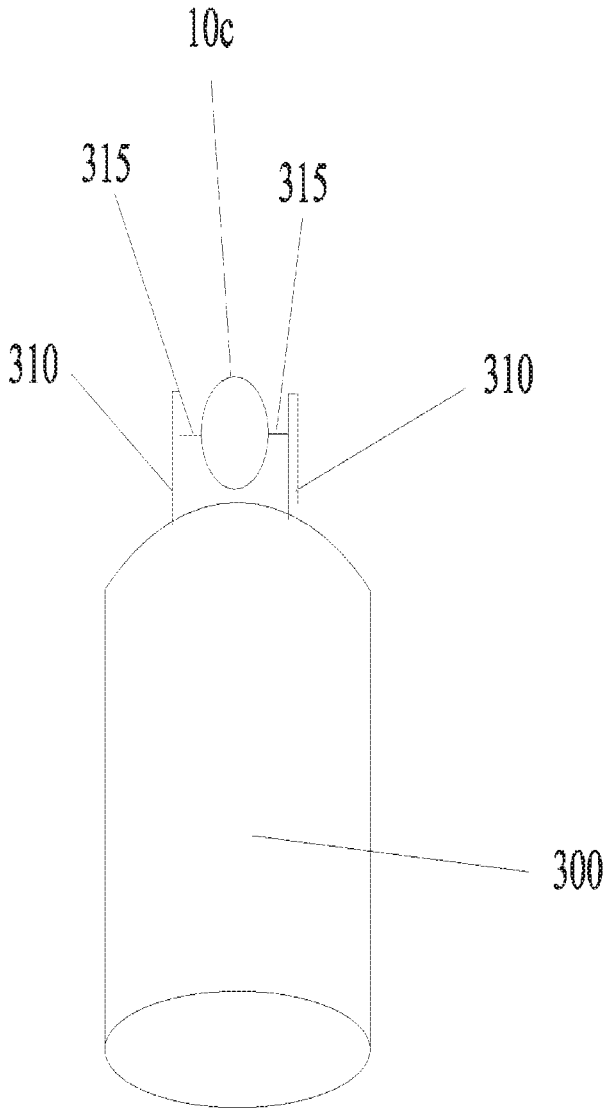
FIG. 3 is a perspective view of a POAFLS attached to a container with a hinged mount allowing the POAFLS to remain approximately level while the container moves beneath it.

FIG. 2 is a perspective view of container 200. Two lift structures or POAFLS 10*b* are attached in positions opposed to each other on the neck of container 200. Placing the last segment of a finger from hand 50*b* under each of the contact surfaces of the two POAFLS 10*b* allows container 200 to be lifted, carried, or transported comfortably. The placement of these two POAFLS 10*b* allows the center of a lifting force applied to the two POAFLS 10*b* to be aligned with the center of gravity of container 200 when they are in use, such as when the container is being lifted. This allows the container to maintain an orientation comfortable for the user while the user utilizes POAFLS 10*b*, FIG. 3 is a perspective view of container 300. The lift structure or POAFLS 10*c* is attached to the container 300 by structure that includes dual hinge pins 315 each attached to an upper end of one of a pair of support arms 310 that extend upward from a container 300. The other ends of the support arras are attached in turn to container 300. This allows container 300 to swing freely under POAFLS 10*c* while POAFLS 10*c* maintains a constant bottom surface-down orientation. Container 300 will return to a position where the center of gravity of container 300 is directly beneath ROARS 10*c* when container 300 is lifted.

Figure 4:
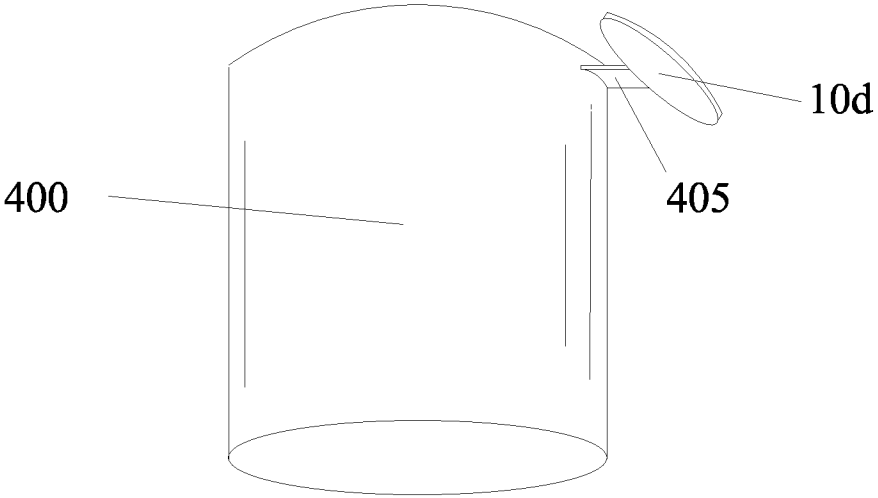
FIG. 4 is a perspective view of a POAFLS attached to the side of an object at an angle that allows the contact surface of the POAFLS to become approximately level as the object to which it is attached moves its center of gravity to beneath the POAFLS.

FIG. 4 is a perspective view of container 400. The lift structure or POAFLS 10*d* is attached at an angle of less than 90°, to a support arm 405 which is in turn attached to container 400. The angle is defined by the bottom surface of the lift structure 10*d* and an attachment surface of the side of the container 400 to which the support arm 405 is attached. POAFLS 10*d* is attached at an angle that allows lift structure 10*d* to remain approximately level while the center of gravity of container 400 is hanging beneath POAFLS 10*d*. This aids in maintaining effective contact of a user's finger with POAFLS 10*d* while POAFLS 10*d* is in use.

Figure 5:
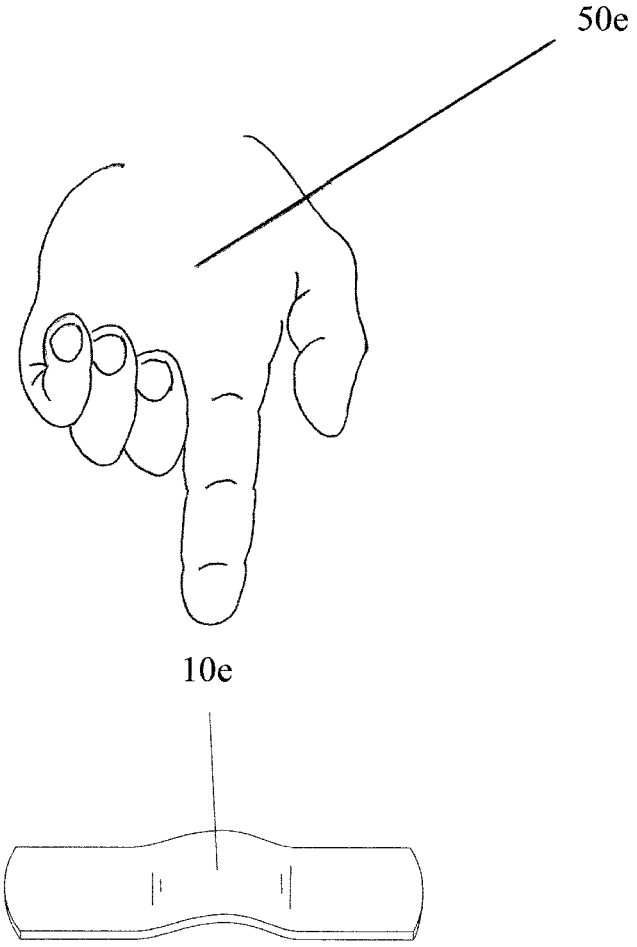
FIG. 5 is a perspective view of POAFLS with curved contact surfaces. This allows the force applied to the POAFLS to be distributed in a more even fashion over the finger contacting the POAFLS to increase the users comfort.

FIG. 5 is a perspective view of POAFLS 10*e*. POAFLS 10*e* has a curved contact or bottom surface. This provides a more effective distribution of force on the finger of hand 50*e* applying force to POAFLS 10*e*, allowing the POAFLS 10*e* to be comfortably used with heavier loads.

Figure 6:
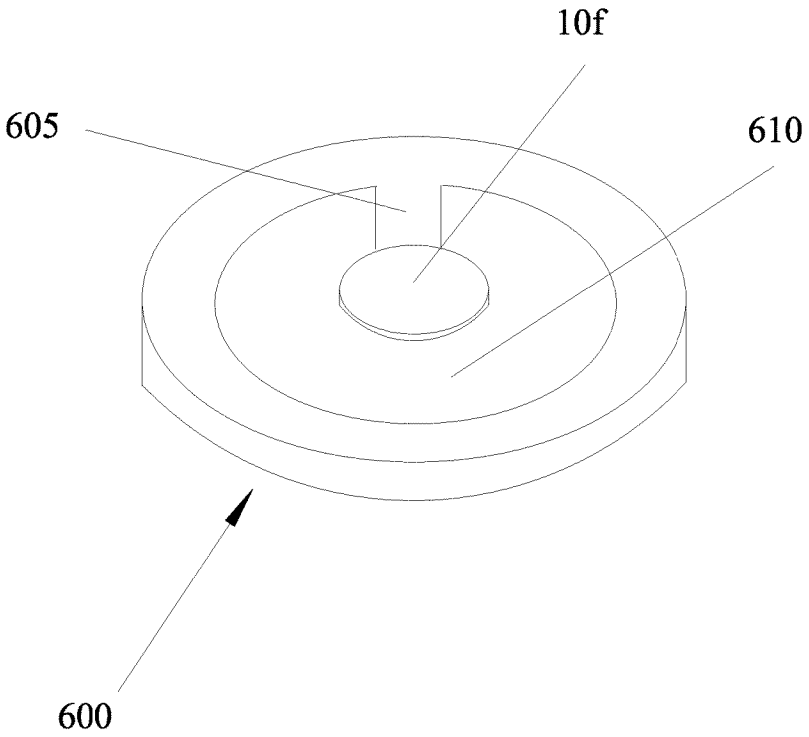
FIG. 6 is a perspective view of a POAFLS attached to a cap over a depression in the cap.

FIG. 6 is a perspective view of lid 600. POAFLS or lift structure 10*f* is attached to support arm or attachment element 605 which is in turn attached to lid 600. A depression 610 accounting for most of the central surface area of the lid allows convenient access to the contact surface on the bottom side of POAFLS 10*f*.

Figure 7:
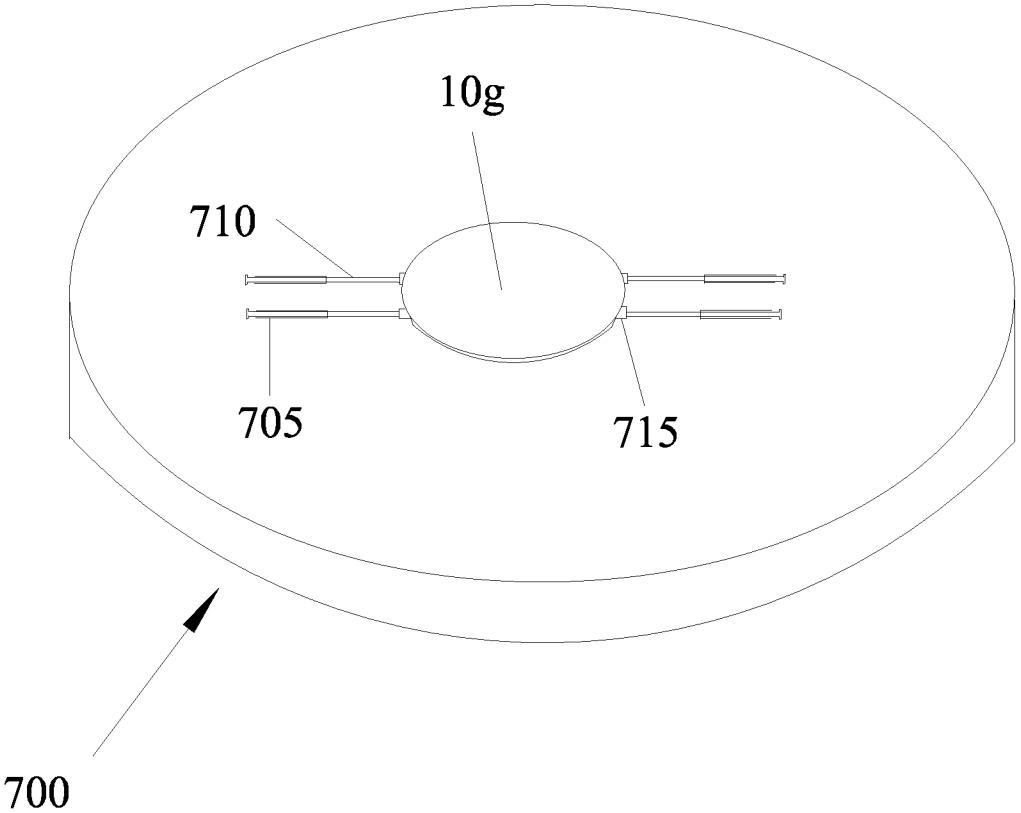
FIG. 7 is a perspective view of a POAFLS attached to a cap by means of legs that slide into place as the POAFLS is raised from the cap.

FIG. 7 is a perspective view of lid 700 configured with a lift structure or POAFLS 10*g*. POAFLS 10*g* is connected to four points on the perimeter of the lid 700 by four support legs 710. The support legs 710 are attached to the POAFLS 10*g* by slides 715. Each of the support legs 710 is attached to lid 700 via one of the feet 705. The combination of the hinges 715, support legs 710 and feet 705 allows POAFLS 10*g* to be raised up and away from the lid 700 for use. This design also allows the lid to have a minimized impact on current production lines. Although four legs are used here other numbers of legs are envisioned as well. Although a hinge is used here to attach the legs to the lid and POAFLS other means are envisioned as well.

Figure 8:
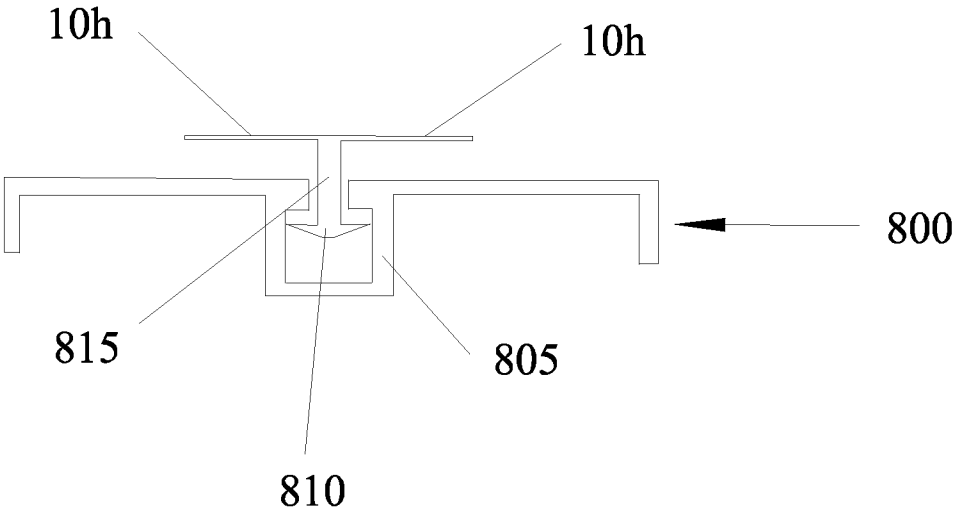
FIG. 8 is a perspective view of a POAFLS attached to a cap by means of a leg that slides up from a depression in the cap as the POAFLS is raised from the cap.

FIG. 8 is a perspective view of lid 800 equipped with two lift structures or POAFLS 10*h*. Two POAFLS 10*h* are positioned on opposing sides to each other at the top of leg 815. Leg 815 descends through an opening in the center of lid 800 into well 805. Anchor 810 is attached to the bottom of leg 815 and is shaped to be slidably engageable with the lid 800 and block removal of the anchor 810 from the well 805. The walls of well 805 stabilize leg 815 and anchor 810. Anchor 810 will contact the ceiling of well 805 when leg 815 is raised, preventing it from exiting well 805. The ability to raise and lower POAFLS 10*h* allows for easy access for use. They also allow POAFLS 10*h* to be easily secured to simplify production line processes, shipping needs, and stacking and storage in stores and final customer sites. POAFLS 10*h* allow the lid and whatever container it is secured to be lifted using two single point of contact methods. Though one leg 815 and two POAFLS 10*h* are used here other numbers of legs and POAFLS are envisioned.

Figure 9:
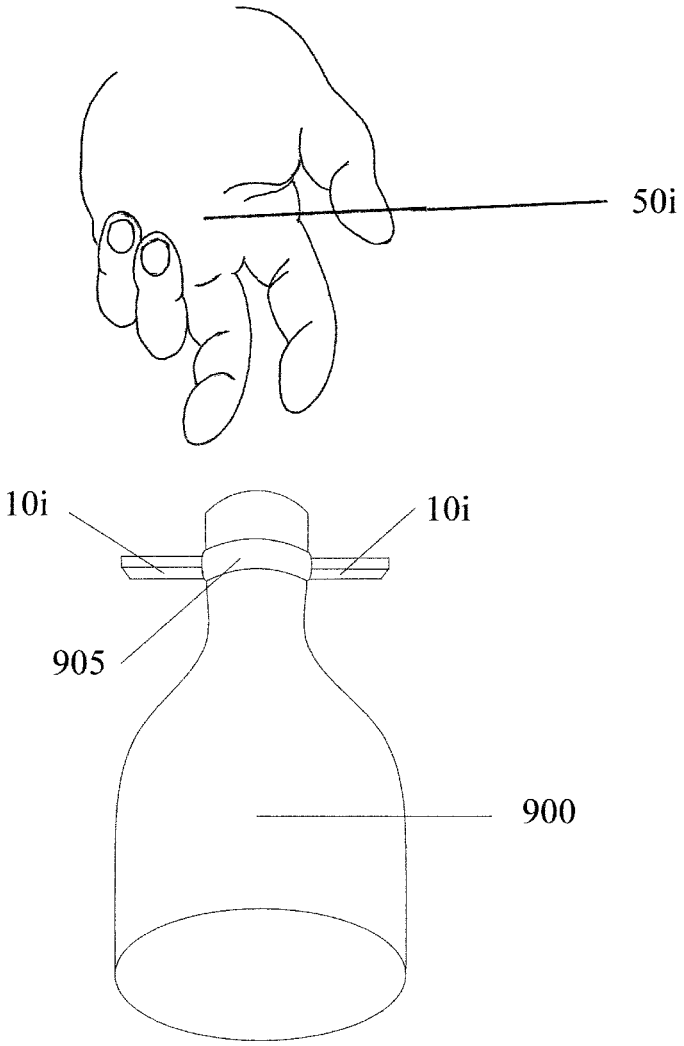
FIG. 9 is a perspective view of a POAFLS attached to a ring which is in turn attached to a container.

FIG. 9 is a perspective view of container 900, which has the shape of a round bottle with a body that tapers to a slender neck. Amounting ring 905 is attached to and extends around the neck of container 900. The mounting ring 905 may be of a size and shape to fit the neck of the container. Two lift structures or POAFLS 10*i* are attached to the mounting ring 905 and extend laterally and horizontally in positions opposed to each other on mounting ring 905. The angle between the bottom surface of each projection 10*i* and the central vertical axis of the container 900 may be approximately ninety degrees. Placing two fingertips of a user's hand 50*i* under respective ones of the contact surfaces of the two POAFLS 10*i* allows container 900 to be lifted, carried, or transported comfortably. The placement of these two POAFLS 10*i* aligns the center of the force applied to the two POAFLS 10*i* with the center of gravity of container 900 when the POAFLS 10*i* are in use. This allows container 900 to maintain an orientation comfortable for the user while POAFLS 10*i* are in use.

The invention claimed is:

1. A lifting device attached to a container having a mouth, said lifting device comprising:

a lid configured to be attached to and cover the mouth of the container, the lid includes a centrally located depression;

a lift structure attached to the lid and located above the lid, the lift structure is circular and substantially planar in its respective entirety, the structure has a front and bottom opposing surface, the bottom surface is substantially planar and includes a contact surface facing downward toward the lid when the lifting device is attached to the container, enabling a user to lift the container by applying an upward force of a single finger on the contact surface; and wherein the lift structure is attached to a support arm and located above the depression spaced upwardly apart from the lid so that the depression allows the single finger access to the bottom surface.

2. A lifting device attached to a container having a mouth, said lifting device comprising:

a lid configured to be attached to and cover the mouth of the container; and a lift structure attached to the lid and located above the lid, the lift structure is circular and substantially planar in its respective entirety, the structure has a front and bottom opposing surface, the bottom surface is substantially planar and includes a contact surface facing downward toward the lid when the lifting device is attached to the container, enabling a user to lift the container by applying an upward force of a single finger on the contact surface; and wherein the lift structure is attached to the lid by a combination of at least one sliding leg having two ends, and a hinge, wherein the hinge connects one end of the at least one sliding leg to the lift structure and the other end of the sliding leg is connected to the lid, allowing the at least one lift structure to be raised from the lid.

3. A lifting device for attachment to a container, comprising:

a mounting element, structurally adapted to be attached to a neck of a container having a body and a relatively slender neck to the body of the container;

two lift structures axially parallel to the mounting element, the lift structures being attached to and extending laterally and oppositely away from the mounting element, each structure comprise a solid linear plane having a front and bottom opposing surface, the bottom surface includes a substantially planar contact surface located where a user can comfortably lift a container to the neck of which the lifting device is attached with an upward force of a respective single finger on each contact surface.

4. The lifting device of claim 3, wherein the two lift structures are located where upward forces of single fingers, each applied to a bottom surface of a respective one of the two lift structures, are, as combined, aligned with a center of gravity of the container.

5. The apparatus of claim 3, wherein an angle between the bottom surface of one of the lift structures and a side of the container is less than ninety degrees.

6. The lifting device of claim 3 wherein the mounting element includes a ring element of a shape and size adapted to fit to the neck of the container, and wherein the two lift structures are attached to and extend horizontally from opposite positions on the ring element when the lifting device is attached to the neck of the container.

7. The lifting device of claim 3 wherein the lift structures are located with respect to the mounting element where a user can comfortably place each of a pair of single fingers that are adjacent to each other on the user's hand under, and apply force against, a respective one of the contact surfaces to lift a container to which the lifting device is attached.

8. The lifting device of claim 3 wherein the mounting element includes a mounting ring that is adapted to be attached to the neck.

9. The lifting device of claim 3 wherein the contact surface of at least one of the at least two lift structures is textured.

10. A lifting device configured to be attached to a bottle having a slender bottle neck, said lifting device comprising:

a mounting element, structurally adapted to extend around the bottle neck; and a pair of substantially flat lift structures axially parallel to the mounting element, each lift structure is substantially planar and solid in its entirety, each structure having a front and bottom opposing surface, the bottom surface includes a substantially planar contact surface located so as to face toward a bottom portion of the bottle when the lifting device is attached to the bottle neck, the lift structures being located so as to extend radially from opposite sides of the bottle neck when the lifting device is attached to the bottle neck, and the bottom surfaces being located where a user can comfortably lift the bottle with an upward force of a respective single finger on each bottom surface.

11. A lifting device configured to be attached to a container having a mouth, said lifting device comprising:

a lid configured to be attached to and cover the mouth of the container; and a lift structure attached to the lid and located above the center of the lid, the lift structure is circular and substantially planar in its respective entirety, the structure has a front and bottom opposing surface, the bottom surface is substantially planar and includes a contact surface facing downward toward the lid when the lifting device is attached to the container, enabling a user to lift the container by applying an upward force of a single finger on the contact surface.

12. The apparatus of claim 11, wherein the lift structure is attached to the lid by dual support legs and dual hinges, the hinges connecting the lift structure to the dual support legs and the dual support legs being connected with the lid, the legs are linear and may selectively extend in length towards the lift structure.

13. A lifting device attached to a container, comprising:

a pair of linear support arms attached to a container and extending upward from the container;

a lift structure that, comprises a solid circular plane having a front and bottom opposing surface, the bottom surface is substantially flat and facing downward toward the container, the bottom surface including a contact surface located where a user can lift the container by applying an upward force of a single finger on the contact surface; and a pair of hinges interconnecting the lift structure to the support arms.

* * * * *